US008020590B2

(12) United States Patent
Togni

(10) Patent No.: US 8,020,590 B2
(45) Date of Patent: Sep. 20, 2011

(54) NOZZLE FOR FILLING A CONTAINER WITH AT LEAST TWO VISCOUS MATERIALS

(75) Inventor: Giancarlo Togni, Urgnano (IT)

(73) Assignee: TGM Tecnomachines S.R.L., Urgnano (IT)

( * ) Notice: Subject to any disclaimer, the term of this patent is extended or adjusted under 35 U.S.C. 154(b) by 1012 days.

(21) Appl. No.: 11/791,314

(22) PCT Filed: Nov. 22, 2005

(86) PCT No.: PCT/IB2005/003502

§ 371 (c)(1),
(2), (4) Date: Jul. 13, 2007

(87) PCT Pub. No.: WO2006/056855

PCT Pub. Date: Jun. 1, 2006

(65) Prior Publication Data

US 2008/0041490 A1 Feb. 21, 2008

(30) Foreign Application Priority Data

Nov. 25, 2004 (IT) ..... MI2004A2284

(51) Int. Cl.
*B65B 3/04* (2006.01)

(52) U.S. Cl. ..... 141/104; 141/105; 141/302; 141/392; 222/140; 222/145.2; 222/488

(58) Field of Classification Search ..... 141/2, 18, 141/104, 105, 301, 302, 392; 222/138–140, 222/145.1–145.2, 481, 488
See application file for complete search history.

(56) References Cited

U.S. PATENT DOCUMENTS

| | | | | |
|---|---|---|---|---|
| 3,559,700 | A | 2/1971 | Erickson | |
| 3,952,782 | A * | 4/1976 | Mannara | 141/100 |
| 4,308,900 | A | 1/1982 | Vadas | |
| 5,590,818 | A * | 1/1997 | Raba et al. | 141/99 |
| 6,161,723 | A * | 12/2000 | Cline et al. | 222/138 |
| 6,223,949 | B1 * | 5/2001 | Spencer et al. | 222/140 |
| 6,418,986 | B1 * | 7/2002 | Gabriele | 141/100 |
| 6,478,041 | B1 | 11/2002 | Stede | |
| 7,559,346 | B2 * | 7/2009 | Herrick et al. | 141/105 |
| 2002/0029819 | A1 | 3/2002 | Gabriele | |

FOREIGN PATENT DOCUMENTS

| | | |
|---|---|---|
| EP | 1 207 108 | 5/2002 |
| GB | 458709 | 12/1936 |
| GB | 813514 | 5/1959 |
| GB | 872947 | 7/1961 |

OTHER PUBLICATIONS

International Search Report for PCT/IB2005/003502 mailed Apr. 21, 2006

* cited by examiner

*Primary Examiner* — Gregory Huson
*Assistant Examiner* — Nicolas A Arnett
(74) *Attorney, Agent, or Firm* — Nixon & Vanderhye P.C.

(57) ABSTRACT

Nozzle for filling a container with at least a first and a second viscous or paste-like material, of the type including an outer cylindrical body having a delivery mouth. The nozzle has at least two cylindrical chambers, placed inside an outer cylindrical body and fluidly separated, for the respective passage of the first and of the second viscous material, each of the at least two chambers having an outflow section of the relative viscous material substantially positioned in correspondence to a delivery mouth.

36 Claims, 2 Drawing Sheets

NOZZLE FOR FILLING A CONTAINER WITH AT LEAST TWO VISCOUS MATERIALS

This application is the U.S. national phase of International Application No. PCT/IB2005/003502 filed 22 Nov. 2005 which designated the U.S. and claims priority to IT MI2004A002284 filed 25 Nov. 2004, the entire contents of each of which are hereby incorporated by reference.

FIELD OF THE INVENTION

The present invention relates to a new nozzle for simultaneously filling, with at least two viscous fluid materials, a container, such as a flexible tube, a bottle, a jar, for hygienic substances, cosmetics or foodstuffs, etc., and to a new method for filling said container with at least two viscous materials.

PRIOR ART

In prior art it is known that containers of various types are filled with viscous or paste-like material using shaped nozzles in which the filling material is forcedly introduced, for example using pressure, or thrust by a metering screw (i.e. an auger), and it is then made to flow into said container until this latter is full, when the outflow of viscous material from the nozzle is usually interrupted by an appropriate shutter. The delivery mouth of the nozzle is shaped so that the viscous material, flowing into the container, fills it adapting to the geometry of the latter, according to methods established in the design phase of the nozzle and of the container.

For example, British patent GB 458,709 in the name of BROR teaches to realize a nozzle for filling a container with a paste-like material, the nozzle including a cylindrical inner body provided with a delivery mouth for the material, and an outer sleeve which is coaxial with the above mentioned cylindrical body and which can slide axially with respect thereto. The delivery mouth has a truncated cone shape and has outflow sections for the viscous material along the side wall thereof. The outer sleeve is shaped so that it closes the outflow sections of the delivery mouth when said sleeve is positioned such a way as to engage contacting the delivery mouth of said nozzle.

British patent GB 872,947 in the name of UNILEVER describes a cylindrical nozzle for controlled delivery of a viscous material into a container, having two coaxial cylindrical bodies defining between them a first outer chamber for the passage of the viscous material, and a second central chamber, defined by the innermost cylindrical body, for the passage of a cleaning fluid, such as compressed air. At each filling cycle of a container, the nozzle can be cleaned by a jet of compressed air made to flow through said central chamber.

Instead, to fill a container with at least two viscous or paste-like materials, the use of different nozzles for each material is known, in order to feed the two or more viscous materials avoiding undue mixtures or contamination, at different times and in different locations within the container. Also known is the use of the same nozzle to deliver in sequence two or more viscous materials into the same container, with a cleaning cycle for the nozzle interposed between the use of one material and the other.

The aforesaid patent GB 872,947 UNILEVER shows how to fill a container with two different paste-like materials through a loading cycle for feeding a first material into the container and a subsequent loading cycle for feeding the second material. The nozzle described in this UNILEVER patent can be proper for use with two different subsequent, paste-like, materials, owing to the relative simplicity of the cleaning operations of this nozzle, guaranteed by the presence of the compressed air cleaning duct.

Attainment of specific aesthetic effects in the combination of viscous materials introduced in the container is also normally delegated to the methods of filling the container or to the geometry of said container and of the outflow section thereof, as described, for example, in British patent GB 813, 514, in the name of MARRAFFINO.

In view of above, however, the filling of a container with at least two viscous materials, especially when wishing to obtain specific combinations of these materials for aesthetic purposes, is a complex operation, due to the geometrical constraints linked to depositing the materials in different locations inside the container, and is a costly operation in terms of time, and therefore of the resources used, due to the sequence of operations to fill the container, and possible cleaning of the nozzle or nozzles, with both the viscous materials.

Therefore a wide need is felt, within the technical field of devices and techniques for filling containers with viscous materials, to minimize the times and the complexity of operations required to fill a container, when it is to be filled with at least two viscous materials.

SUMMARY OF THE INVENTION

The present invention thus proposes a solution to the drawbacks of prior art mentioned above, by providing a new nozzle and a method for filling a container with at least two viscous materials, wherein a particular combination of these two materials inside the container can be obtained with a single filling operation.

Another object of the present invention is to produce a nozzle to fill a container with at least two viscous products which is easy to produce, easy to use and proves to be efficient in said filling operation.

A further object of the present invention is to provide a method to fill a container with at least two viscous materials, which is easy to implement and reduces the times required for said filling.

These and other objects are obtained by the nozzle as claimed in independent claim 1 and the subsequent dependent claims, and by a method to fill a container with at least two viscous materials as claimed in independent claim 14 and the subsequent claims dependent thereon.

The new nozzle to fill a container with at least a first and a second viscous material, according to the present invention, includes an outer cylindrical body having a delivery mouth and at least two cylindrical chambers, inside the outer cylindrical body and fluidly separated, for the passage of the first and of the second viscous material respectively. Each of these two chambers has an outflow section of the relative viscous material substantially positioned in correspondence to the delivery mouth of the outer cylindrical body.

The use, in a single nozzle with a single delivery mouth, of two separate chambers for the two different viscous materials, easily allows a container of any type to be filled with two materials arranged inside said container without two consecutive filling operations required for the two materials.

Moreover, according to a preferred aspect of the present invention, the two inner cylindrical chambers are coaxial and can be easily obtained, during the production phase of the nozzle, by using a single cylindrical body inserted coaxially into the outer body.

This conformation of the nozzle allows any container to be filled with the viscous materials arranged according to annular portions concentric with each other.

It should be noted that here and hereunder the term "cylindrical body" is intended generically as a body whose surface is defined by an plurality of generatrix lines, parallel to one another, and incident to a closed directrix, not necessarily regular or curved. It should also be stressed that this definition can be adapted, without distinction, to bodies which can be rigid or flexible, such as ducts for the distribution of viscous or paste-like materials.

According to a preferred aspect of the present invention, the nozzle can include a further cylindrical tube, that is coaxial and placed inside the two cylindrical chambers, provided to distribute a auxiliary fluid, such as compressed air to clean said nozzle.

According to another aspect of the present invention, the inner cylindrical body defining the two chambers and the inner coaxial tube for the auxiliary fluid can slide in relation to each other and to the outer cylindrical body of the nozzle, and therefore they can be shaped so as to form shutters for the two chambers of viscous materials, when said inner cylindrical body and the tube for the auxiliary fluid reach a predefined position of engagement with the delivery mouth of the nozzle.

Therefore, delivery of the viscous material through the nozzle of the present invention can easily be controlled thanks to the sliding, if necessary assisted by suitable driving means, of said inner cylindrical body and said tube for the auxiliary fluid.

The method to fill a container with at least two viscous or paste-like materials, according to the present invention, envisages that at least two viscous materials are made to flow into the container, substantially in a simultaneous way, through at least two outflow sections open in correspondence to one single delivery mouth of the viscous materials into the container. Each of the two viscous materials is delivered through a specific separate section of the two outflow sections.

When the outflow sections are circular and concentric, according to a preferred aspect of the present invention, the method allows to fill the container with the viscous materials arranged according to annular and concentric portions.

BRIEF DESCRIPTION OF THE FIGURES

A preferred embodiment of the nozzle according to the present invention will now be illustrated purely by way of a non-limiting example, with reference to the accompanying figures, wherein.

DETAILED DESCRIPTION OF SOME PREFERRED EMBODIMENTS OF THE PRESENT INVENTION

With reference in general to the accompanying figures, the valve shown to fill a generic container (not shown) with at least two viscous or paste-like materials, includes a nozzle 1 fed by two ducts 2 and 3 inside which two separate viscous or paste-like materials, with which said container is to be filled, are made to flow, preferably in a forced manner. The viscous materials flowing in the ducts 2 and 3 can, according to prior art, be contained in suitable reservoirs, not shown, and then forced to flow through the nozzle 1 by a pump or by a metering screw (auger), neither of which are shown.

Figure 2:
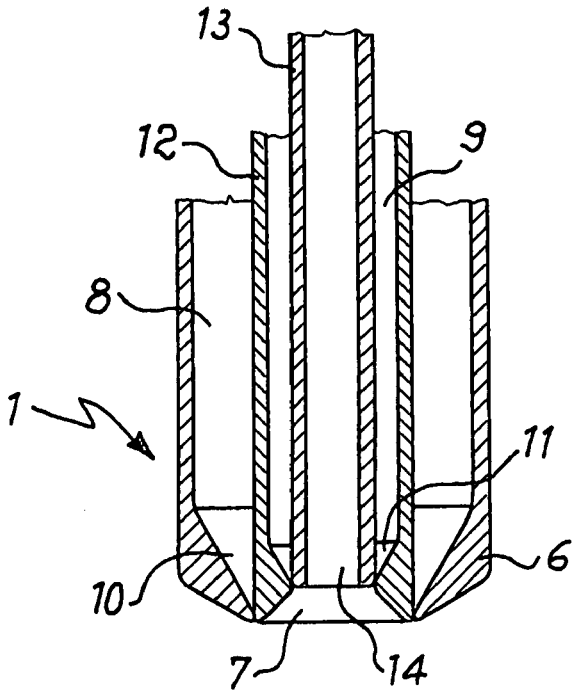
FIG. 2 is an enlarged sectional side view of the lower end of the nozzle in the valve of FIG. 1, in a configuration in which delivery of the viscous materials is prevented.
Figure 3:
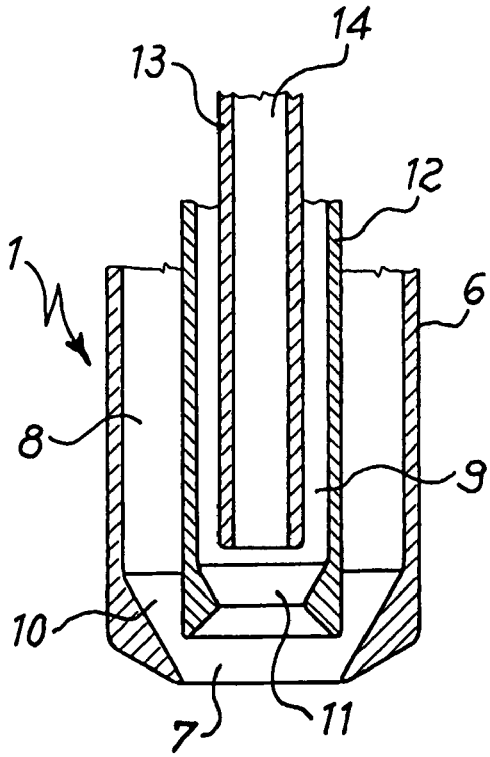
FIG. 3 is the same view of the lower end of the nozzle of FIG. 2, but the nozzle is in a configuration in which delivery of the viscous materials is permitted.

As shown in particular in FIGS. 2 and 3, the nozzle includes a hollow outer cylindrical body 6, with a properly shaped delivery mouth 7 for the viscous materials. The delivery mouth 7 should engage within the container to be filled and it may therefore have any geometrical shape which is proper for the geometry of said container.

Inside the outer cylindrical body 6 are two cylindrical chambers 8, 9, fluidly separated from each other and placed in fluid communication, through connectors, not shown, and a suitable set of apertures, with the ducts 2 and 3 of the viscous or paste-like materials. The cylindrical chambers 8 and 9 have respective outflow sections 10 and 11 placed in correspondence to the delivery mouth 7, so that separate discharge of the viscous materials from ducts 2 and 3 can take place, simultaneously, in correspondence to said delivery mouth 7 of nozzle 1.

More specifically, according to a preferred aspect of the present invention, an inner cylindrical body 12 is coaxially housed within the cylindrical body 6, the inner cylindrical body 12 dividing the inner volume of said body 6 into two cylindrical chambers, also in this case coaxial, 8 and 9, fluidly separated from each other and in fluid communication with ducts 2 and 3, respectively. The two cylindrical chambers 8 and 9 have thus the function of allowing the filling of the container with the viscous materials so that said materials are arranged according to concentric annular portions.

Figure 1:
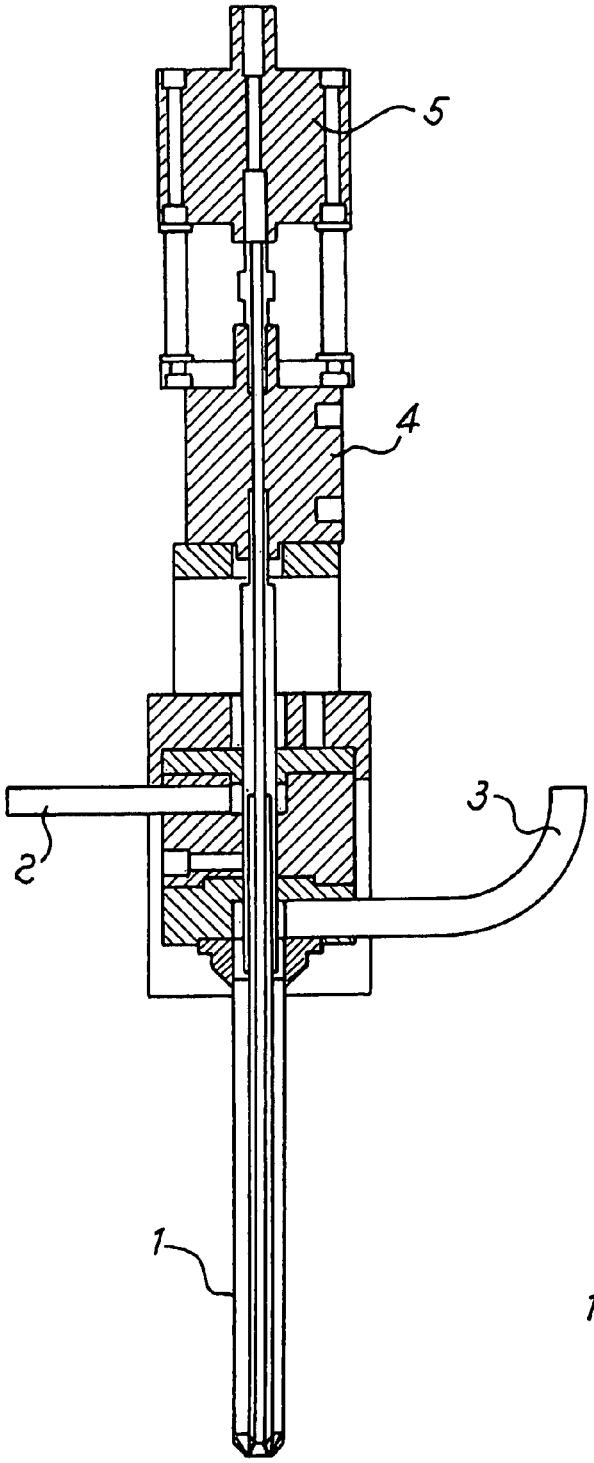
FIG. 1 is a schematic sectional side view of a delivery valve of at least two viscous or paste-like materials, provided with a nozzle according to a particular aspect of the present invention.
Figure 4:
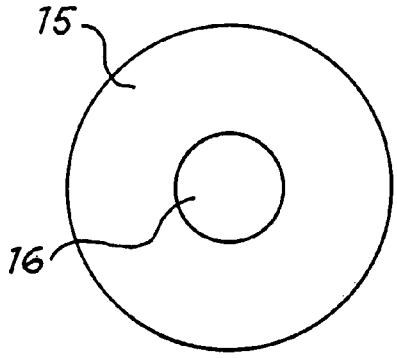
FIG. 4 is a top plan view of two viscous materials delivered into a cylindrical container from the nozzle of the previous figures.

FIG. 4 shows a plan view of a possible arrangement of two viscous materials 15 and 16 inside a container, obtained for example with the nozzle indicated in FIGS. 1-3. In the case in which the container is cylindrical, such as a tube, the two materials 15 and 16 can be shaped as solid coaxial cylindrical bodies inside said container.

In the particular embodiment of the invention herein illustrated, nozzle 1 also has a duct 14 which is defined, advantageously, by a cylindrical tube 13, internal and coaxial with the inner cylindrical body 12, and which has the function of permitting distribution of a auxiliary fluid inside nozzle 1, for example a cleaning fluid like compressed air.

It should be observed that said duct 14 could be constituted, in alternative embodiments of the nozzle 1, by any duct, positioned in any way and having any shape, inside or outside the outer cylindrical body 6, which has the function of conveying the above mentioned auxiliary fluid to nozzle 1, without departing from the scope of protection requested for the present invention. Although nozzle 1 described above can have conventional shutters to regulate the flow of viscous materials, and optionally of the auxiliary fluid, inside nozzle 1, for example including diaphragm valves positioned in correspondence to ducts 2 and 3 of the viscous materials and to duct 14 for the auxiliary fluid, the present invention provides a new and inventive embodiment of these shutters.

In fact, according to a preferred aspect of the present invention, the inner cylindrical body 12 of the nozzle 1 can slide axially, that is to say along its own axis, with respect to the outer cylindrical body 6, and the inner walls of the delivery mouth 7 of the nozzle 1 and the outer surface of the end portion (in correspondence to the outflow section of the material) of the inner body 12 can engage mutually, so that the outflow section 10 of the chamber 8 can be closed or open as a function of the relative (axial) position of the body 12 with respect to the body 6.

More specifically, the inner surface of the delivery mouth 7 of the nozzle 1 has the shape of a truncated cone, tapered towards the outlet, and the outer surface of the end portion of the inner cylindrical body 12 has an annular section with a diameter suitable to couple, substantially forming a seal, with the most-reduced diameter portion of the inner surface of the mouth 7. Therefore, relative movement of the inner body 12 with respect to the inner body 6 and consequently with respect to the delivery mouth 7, determines, as a function of the relative position of the bodies 6 and 12, engaging or disengaging of said outer annular section of the body 12 with the inner surface of the mouth 7 and consequently the closure or opening of the outflow section 10 of the chamber 8.

Movement of the body 12 with respect of the body 6, eventually moved by suitable driving means, such as a pneumatic jack 4, thus determines delivery of the viscous material present in the cylindrical chamber 8, from the delivery mouth 7 into the container.

Similarly, the cylindrical tube 13 can also advantageously slide axially with respect to the outer cylindrical body 6 and to the inner cylindrical body 12 and have its own end portion, in correspondence with its own fluid outlet section, shaped in such a way to engage and form a seal with the inner surface of the end outlet portion of the inner cylindrical duct 12, said end portion internally having the shape of a truncated cone, tapering towards the outflow section 11.

Matching of the end outlet portion of the tube 13 with the inner surface of the end outlet section of the cylindrical body 12, when said end portion of the tube 13 engages with the inner part with minimum diameter of said end section of the body 12, allows the outflow section 11 of the chamber 9 to be closed (or clogged), thereby preventing delivery of the viscous material made to flow into said chamber 9. On the contrary, axial sliding of the tube 13, for example by means of a pneumatic jack 5, away from the engaged position closing the tube 13 with the body 12, allows delivery of the viscous material from the outflow section 11, into the delivery mouth 7 and then into the container (not shown).

According to a preferred aspect of the present invention, the method to fill a container with at least two viscous or paste-like materials, provides that the two viscous or paste-like materials, made to flow from suitable reservoirs through the ducts 2 and 3, pass into the respective chambers 8 and 9 and from these chambers separately reach, substantially simultaneously, the two relative outflow sections 10 and 11, positioned in correspondence to the single delivery mouth 7 of the nozzle 1.

The peculiar configuration of the chambers 8, 9, suitably concentric, according to another aspect of the present invention, thus allows the method described above to carry out the filling of containers with at least two viscous, or paste-like materials, arranged according to concentric annular portions. According to a particular implementation of the method of the present invention, moreover, at the end of each filling cycle of a container, a cleaning step of the nozzle 1 can be provided, by closing the chambers 8 and 9 in advance, and subsequently introducing a jet of compressed air through the duct 14.

Consequently, a possible filling cycle of a container using the new nozzle claimed herein includes the steps of:

a. sliding, by means of jacks 4 and 5, the tube 13 and the inner cylindrical body 12 respectively away from the outflow (or discharge) sections of the chambers 8 and 9, so as to disengage said outflow sections 10 and 11 of said chambers 8 and 9;

b. simultaneously making two viscous or paste-like materials flow into the chambers 8 and 9, from the ducts 2 and 3, to the outflow sections 10 and 11 and then to the delivery mouth 7 of the nozzle, to fill the container;

c. after the container has been filled, sliding, by means of the jacks 4 and 5, the inner cylindrical body 12 to engage with the outflow section 10 of the chamber 8, and the cylindrical tube 13 to engage with the outflow section 11 of the chamber 9, so as to close said chambers 8 and 9, preventing delivery of the viscous or paste-like materials;

d. introducing a jet of compressed air through the duct 14 to wash the nozzle 1;

e. repeating steps a-d to fill subsequent containers.

The invention claimed is:

1. Nozzle for filling a container with at least a first and a second viscous or pasty material, of the type including an outer cylindrical body having a delivery mouth and at least two coaxial cylindrical chambers, placed inside said outer cylindrical body and fluidly separated, for passage respectively of said first and of said second viscous or pasty material, each of said chambers having an outflow section of the relative viscous or pasty material substantially positioned in correspondence to said delivery mouth, said chambers including a cylindrical body inside said outer cylindrical body and an inner cylindrical body inside the cylindrical body, wherein said inner cylindrical body can slide axially with respect to said outer cylindrical body and wherein said nozzle further includes a duct for an auxiliary fluid that can slide axially with respect to said outer cylindrical body and to said inner cylindrical body.

2. Nozzle as claimed in claim 1, further comprising a conduit or path to allow flow of the first and/or second material from respective reservoirs to said chambers.

3. Nozzle as claimed in claim 2, further comprising a drive to slide said inner cylindrical body and/or said duct.

4. Nozzle as claimed in claim 2, wherein said duct for said auxiliary fluid is a cylindrical tube inside and coaxial with said chambers.

5. Nozzle as claimed in claim 4, further comprising a drive to slide said inner cylindrical body and/or said duct.

6. Nozzle as claimed in claim 4, wherein an end outlet portion of said tube is shaped to close a portion, outside said tube, of said inner cylindrical body, when said tube engages with the outlet section of said inner cylindrical body.

7. Nozzle as claimed in claim 6, further comprising a drive to slide said inner cylindrical body and/or said duct.

8. Nozzle as claimed in claim 2, wherein an end portion of said inner cylindrical body is shaped to close the portion of said delivery mouth outside said inner cylindrical body when said inner cylindrical body engages with said delivery mouth.

9. Nozzle as claimed in claim 8, further comprising a drive to slide said inner cylindrical body and/or said duct.

10. Nozzle as claimed in claim 8, wherein said duct for said auxiliary fluid is a cylindrical tube inside and coaxial with said chambers.

11. Nozzle as claimed in claim 10, further comprising a drive to slide said inner cylindrical body and/or said duct.

12. Nozzle as claimed in claim 10, wherein an end outlet portion of said tube is shaped to close a portion, outside said tube, of said inner cylindrical body, when said tube engages with the outlet section of said inner cylindrical body.

13. Nozzle as claimed in claim 12, further comprising a drive to slide said inner cylindrical body and/or said duct.

14. Nozzle as claimed in claim 1, further comprising at least one removable shutter for one or more of said chambers and/or said relative outflow sections.

15. Nozzle as claimed in claim 14, further comprising a drive to slide said inner cylindrical body and/or said duct.

16. Nozzle as claimed in claim 14, wherein said duct for said auxiliary fluid is a cylindrical tube inside and coaxial with said chambers.

17. Nozzle as claimed in claim 16, further comprising a drive to slide said inner cylindrical body and/or said duct.

18. Nozzle as claimed in claim 16, wherein an end outlet portion of said tube is shaped to close a portion, outside said tube, of said inner cylindrical body, when said tube engages with the outlet section of said inner cylindrical body.

19. Nozzle as claimed in claim 18, further comprising a drive to slide said inner cylindrical body and/or said duct.

20. Nozzle as claimed in claim 14, wherein an end portion of said inner cylindrical body is shaped to close the portion of said delivery mouth outside said inner cylindrical body when said inner cylindrical body engages with said delivery mouth.

21. Nozzle as claimed in claim 20, further comprising a drive to slide said inner cylindrical body and/or said duct.

22. Nozzle as claimed in claim 20, wherein said duct for said auxiliary fluid is a cylindrical tube inside and coaxial with said chambers.

23. Nozzle as claimed in claim 22, further comprising a drive to slide said inner cylindrical body and/or said duct.

24. Nozzle as claimed in claim 22, wherein an end outlet portion of said tube is shaped to close a portion, outside said tube, of said inner cylindrical body, when said tube engages with the outlet section of said inner cylindrical body.

25. Nozzle as claimed in claim 24, further comprising a drive to slide said inner cylindrical body and/or said duct.

26. Nozzle as claimed in claim 1, wherein an end portion of said inner cylindrical body is shaped to close the portion of said delivery mouth outside said inner cylindrical body when said inner cylindrical body engages with said delivery mouth.

27. Nozzle as claimed in claim 26, further comprising a drive to slide said inner cylindrical body and/or said duct.

28. Nozzle as claimed in claim 26, wherein said duct for said auxiliary fluid is a cylindrical tube inside and coaxial with said chambers.

29. Nozzle as claimed in claim 28, further comprising a drive to slide said inner cylindrical body and/or said duct.

30. Nozzle as claimed in claim 28, wherein an end outlet portion of said tube is shaped to close a portion, outside said tube, of said inner cylindrical body, when said tube engages with the outlet section of said inner cylindrical body.

31. Nozzle as claimed in claim 30, further comprising a drive to slide said inner cylindrical body and/or said duct.

32. Nozzle as claimed in claim 1, wherein said duct for said auxiliary fluid is a cylindrical tube inside and coaxial with said chambers.

33. Nozzle as claimed in claim 32, further comprising a drive to slide said inner cylindrical body and/or said duct.

34. Nozzle as claimed in claim 32, wherein an end outlet portion of said tube is shaped to close a portion, outside said tube, of said inner cylindrical body, when said tube engages with the outlet section of said inner cylindrical body.

35. Nozzle as claimed in claim 34, further comprising a drive to slide said inner cylindrical body and/or said duct.

36. Nozzle as claimed in claim 1, further comprising a drive to slide said inner cylindrical body and/or said duct.

* * * * *